United States Patent [19]

Finger et al.

[11] 4,103,202

[45] Jul. 25, 1978

[54] ION PROJECTOR HEAD

[75] Inventors: Richard H. Finger, Hollywood; Thomas J. Michel, Miami Lakes, both of Fla.

[73] Assignee: Klykon, Inc., Miami, Fla.

[21] Appl. No.: 747,377

[22] Filed: Dec. 3, 1976

[51] Int. Cl.[2] ..... H01J 1/16; H01J 19/10

[52] U.S. Cl. ..... 313/336; 313/361

[58] Field of Search ..... 315/111.8; 313/336, 313/209, 207, 206, 362, 361

[56] References Cited

U.S. PATENT DOCUMENTS

| | | | |
|---|---|---|---|
| 3,265,918 | 8/1966 | Wittkower | 313/362 |
| 3,649,862 | 3/1972 | Wahlin | 313/361 |

*Primary Examiner*—Alfred E. Smith
*Assistant Examiner*—David K. Moore
*Attorney, Agent, or Firm*—Jackson & Jones

[57] ABSTRACT

An ion projection head designed to provide a fairly uniform cloud of ions over a wide area for use in therapeutic and industrial applications, among others. The head, although being relatively small, generates a large ion cloud in a very efficient manner. A point electrode is located in a cup having a spherical internal surface of curvature. This cup causes the ions to move in a relatively common direction. An iris plate over the mouth of the cup causes the ions generated in the cup to be propelled away from the iris plate.

18 Claims, 5 Drawing Figures

ION PROJECTOR HEAD

BACKGROUND OF THE INVENTION

The present invention relates generally to improvements in free-air ion generation, and, more particularly, pertains to a new and improved ion projection head for use with free-air ion generation apparatus.

The prior art free-air ion generation apparatus, which traditionally are utilized, for example, in industrial environments to neutralize electrostatic charges and in therapeutic applications to affect biological systems, have, for the most part, been ineffective in their function because these prior art ion generators are not capable of projecting ions at a sufficiently rapid rate. These problemns are due in part to the fact that free-air ion generation for the purpose of controlling the charge of an atmosphere is a relatively new field and not well understood. Although the benefits of such a controlled atmosphere have been clearly demonstrated, the widespread use of free-air ion generators in the industrial and therapeutic environments has not come about because of the inefficiencies and dangers present in the state of the art techniques utilized. To eliminate the dangers and to increase efficiency, an ion projector head of the type disclosed in the present application is sorely needed.

OBJECTS AND SUMMARY OF THE INVENTION

An object of this invention is to provide an ion projector head that will provide a relatively extensive ion cloud for its dimensional size;

Another object of this invention is to provide an ion projector head that controls the ion propagation therefrom.

Another object of this invention is to provide an ion projector head that generates an extensive ion cloud with relative safety.

These objects and the general purpose of this invention are accomplished as follows. A point electrode is mounted in an ion cup. The cup has an iris plate mounted over its mouth which has an aperture therethrough. The ion cup and the iris plate form a chamber for the electrode. The migration of ions to the iris plate will exit the chamber through its aperture. The ions will be propelled by the charge on the iris plate into a cloud formation that has a decreasing strength gradient in relation to the distance from the projection head, and is fairly uniform for relatively large radial distances from the projection head.

BRIEF DESCRIPTION OF THE DRAWINGS

Other objects and many of the attended advantages of this invention will be readily appreciated as the same becomes better understood by reference to the following detailed description when considered in conjunction with the accompanying drawings in which like reference numerals designate like parts throughout the figures thereof and wherein:

FIG. 5 is a spherical plot indicating the performance of the ion projection head for various iris plate aperture diameters.

DESCRIPTION OF THE PREFERRED EMBODIMENT

Figure 1:
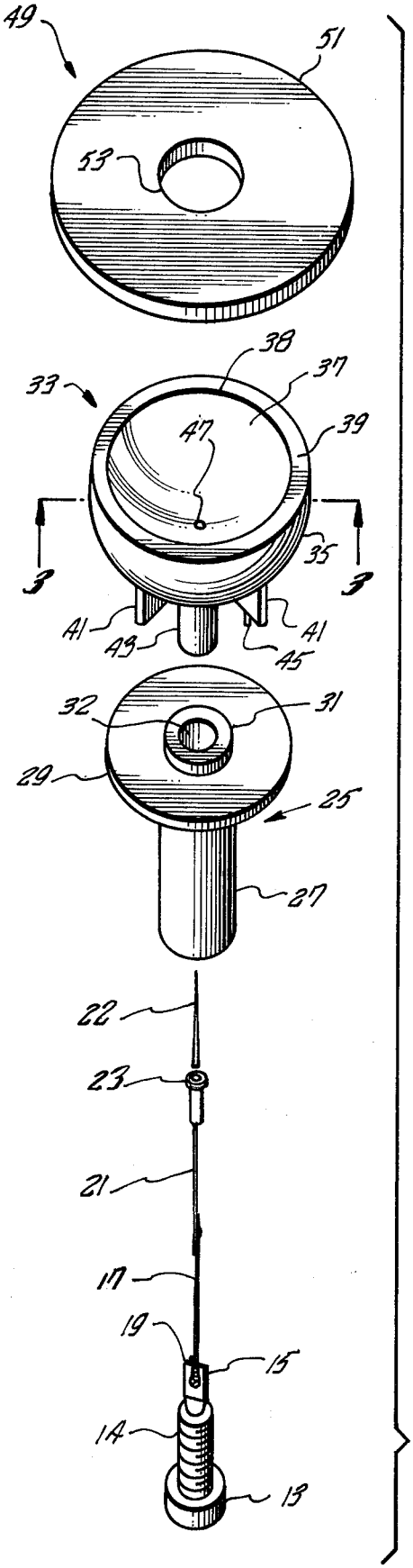
FIG. 1 is an exploded perspective of the preferred embodiment of the present invention.
Figure 2:
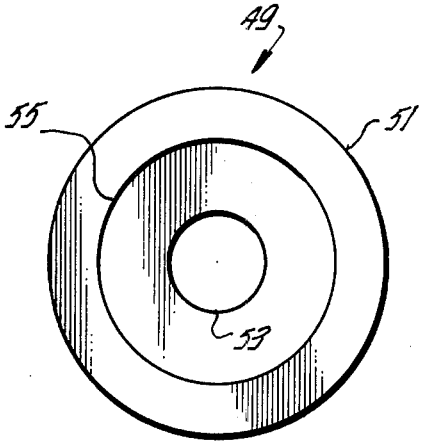
FIG. 2 is a plan view of the back side of the iris plate.

The essential elements of the ion projection head of the present invention are illustrated in the exploded perspective of FIG. 1. An ion cup 33 retains a point electrode 22 at its closed end through a small aperture 47. The ion cup has an internal surface of curvature 37 that is preferably spherical, however other internal surfaces may also be used. The mouth 39 of the ion cup preferably has a circular internal diameter 38. The external surface 35 of the ion cup may conform to the curvature of the internal surface 37.

Figure 3:
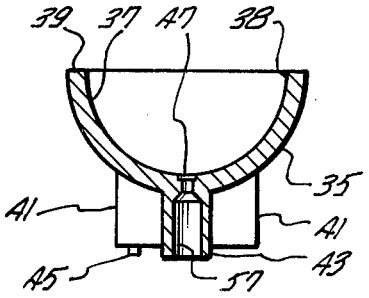
FIG. 3 is a cross-sectional view of the ion cup taken along lines 3—3 of FIG. 1.

As part of the external surface 35, a cylindrical-shaped appurtenance 43 is attached to the closed end of the ion cup 33 so that its axis of symmetry is coincident with the axis of symmetry of the aperture 47 at the closed end. The cylindrical appurtenance 43 has an aperture 57 (FIG. 3) therein through which an electrical conducting wire 17 may pass or a portion of the point electrode may be maintained. The diameter of the cylindrical appurtenance 43 is specifically related to the diameter of the aperture 32 in cylindrical stem 25.

Four fins 41 are attached to the closed end of the ion cup 33 along radial lines extending from the axis of symmetry of the aperture 47 at the closed end of the ion cup. Two of the fins 41 have small appurtenances 45 attached to their underside which are approximately equal in length to the height of the circular boss 31 of the cylindrical stem 25.

The cylindrical stem 25 includes a main cylindrical housing 27, a circular plate 29, and a circular boss 31, all in axial alignment and having a cylindrical aperture 32 therethrough. The cylindrical aperture 32 has a diameter slightly larger than the external diameter of the cylindrical appurtenance 43 of the ion cup 33 so that when the cylindrical appurtenance 43 is inserted into the aperture 32 of cylindrical stem 25, a close tolerance press fit is obtained. The diameter of the circular plate 29 is approximately equal to the radial dimension of the fins 41 on the iris cup 33. When assembled, the ion cup 33 is fastened to the cylindrical stem 25 by having the cylindrical appurtenance 43 inserted into a cylindrical aperture 32 of the stem.

The point electrode 22 which is preferably in the shape of a needle but need not necessarily be so shaped is placed in the ion cup 33 so that its base rests within the recess 23 of the electrode retainer 21. An electrical conducting wire 17 runs through the cylindrical aperture 32 of the cylindrical stem 25 and the aperture 47 of the circular appurtenance 43 to engage the electrode retainer 21 and be electrically mated therewith at the end opposite the recess 23. The other end of the wire 17 is attached to an electrical connector 15, the connection 19 preferably being a solder connection.

The electrical connector 15 is attached to and makes electrical contact with a pluggable connector 13 having a stem housing 14. In the assembled condition, the stem housing 14 of the connector is inserted into the aperture 32 of the cylindrical stem 27 at the end opposite from cylindrical appurtenance 43. The aperture 32 is completely filled with an appropriate insulating-type potting compound prior to the insertion of the stem 14, which compound both insulates the electrical conducting wire 17 and seals the entire unit, including the circular aperture 43, the cylindrical stem 25, and the connector 13 together.

The iris plate 49 is essentially a circular wafer 51 with a circular hole 53 therethrough at its symmetrical center. It fits over the mouth 39 of the ion cup 33. The side of the iris plate 49 attaching to the ion cup 33 has a circular recess 55 thereon which has a diameter that is slightly greater than the outside diameter of the ion cup at its mouth. The mouth of the ion cup thus fits into this circular recess 55 in a snug manner, and is fastened thereto by an appropriate glue. The diameter of the wafer 51 is preferably larger than the external diameter of the ion cup 33 by about $\frac{5}{8}$ of an inch. Although it need not be the diameter of the circular aperture 53, depending on the use to be made of ion projector head preferably ranges from 2 inches smaller than the diameter of the wafer 51 to $\frac{3}{8}$ of an inch smaller than the diameter of the wafer 51. The diameter of the aperture 53 of the wafer 51 will normally not be larger than the internal diameter 38 of the ion cup 33. The preferred dimension of the external diameter of the ion cup at its mouth 39 is $1\frac{5}{8}$ inches with the diameter of the iris plate being $2\frac{1}{4}$ inches. The diameter of the aperture 53 therethrough ranges from $\frac{1}{4}$ to $\frac{7}{8}$ inches.

Figure 4:
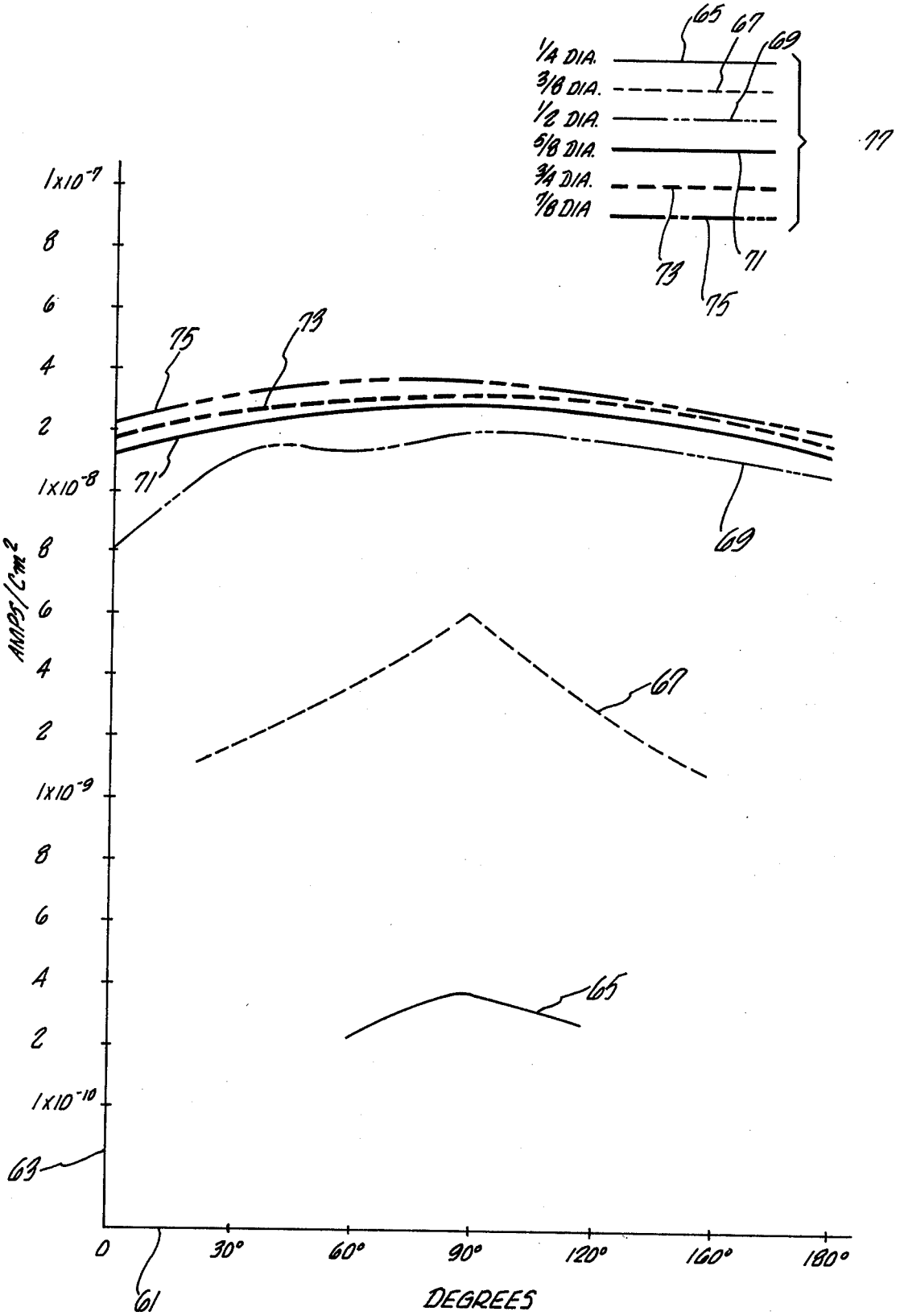
FIG. 4 is a composite graph indicating the performance of the ion projection head for a variety of iris plate aperture diameters.
Figure 6:
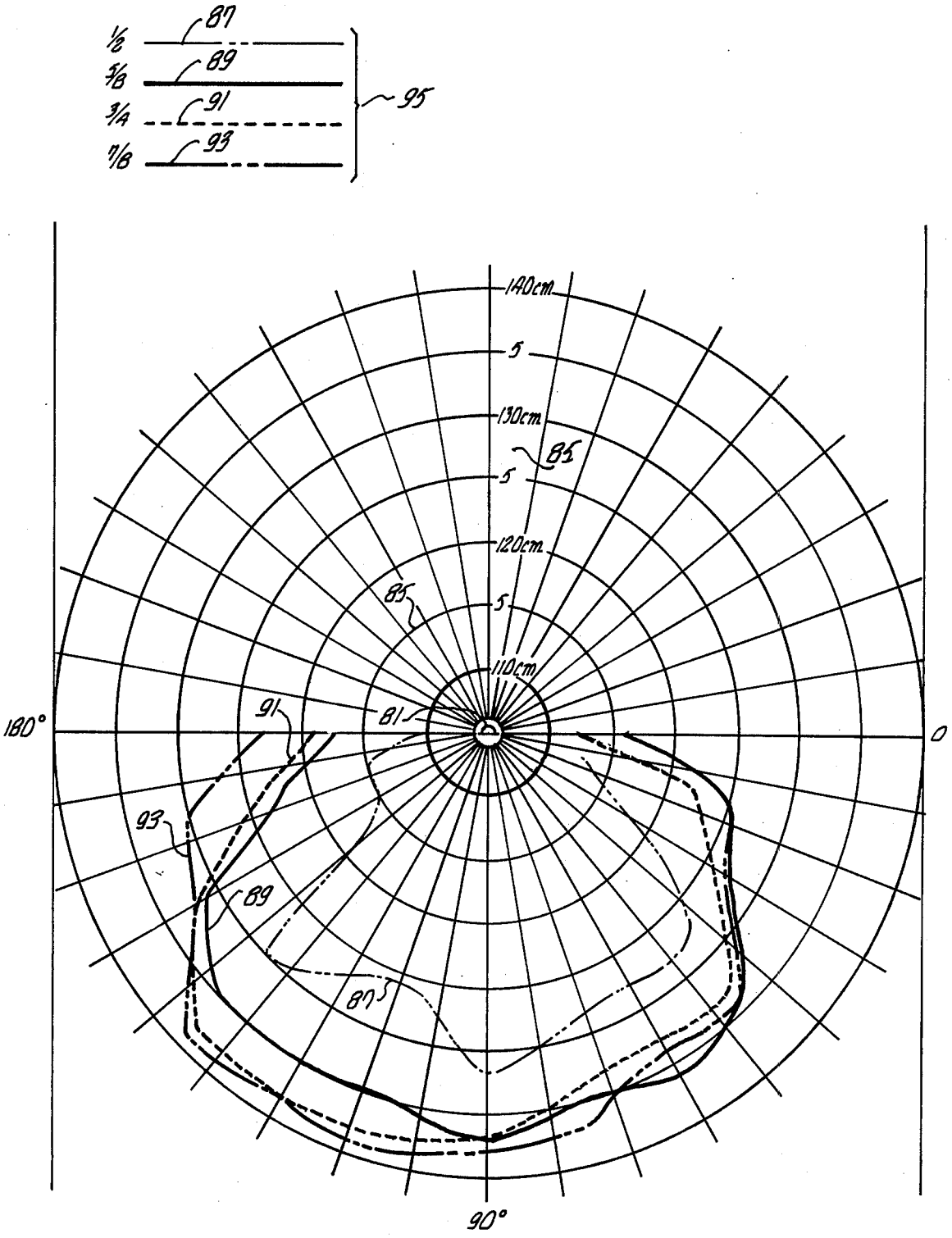

The performance of the ion projector head is exemplified by the graphs of FIGS. 4 and 5 showing test results run on the ion projector head in various dimensional configurations. The graph of FIG. 4 illustrates the results of a hemispherical scan measuring the output of the projector head in current density on the Y axis 63 versus degrees on the X axis 61. The polar plot of FIG. 5 illustrates the constant energy distribution by the projector head for various aperture sizes at the various hemispherical positions.

The test was conducted in a 3 meter by 4 meter by 2 meter room. The ion projection head was mounted in the symmetrical center of the room about 30 centimeters below the ceiling with its mouth lying in a plane parallel to the floor of the test room. The test room was kept at a control humidity and barometric pressure.

Measurements were taken in two orthogonal planes which were perpendicular to the plane of the mouth of the ion cup and the floor of the test room. The readings in each measurement plane were taken at a radial distance of, for example, 1 meter from the open end of the ion cup starting at 0° which would be a radial line lying in the plane of the ion cup mouth. Readings were taken on other radial distances which make angles with the plane in which the mouth of the ion cup is lying until 180°, which would once again be a radial distance lying in the plane of the ion cup mouth. This would also occur for the second measurement plane which would be perpendicular to the first measurement plane. From the readings obtained in these two orthogonal measurement planes, the shape of the ion cloud can be readily determined. The flux density measured in amperes per square centimeter was obtained by use of a probe having a 10 square centimeter area plate thereon.

The composite graph of FIG. 4 illustrates the flux density measurements taken in the two orthogonal measurement planes with the results of the measurements averaged. The ion distribution in one plane has been found to be very similar to that in the other plane. Each of the different plots 65, 67, 69, 71, 73, and 75 illustrate the ion flux density at a radial distance of 1 meter from the projection head for heads utilizing different size iris plate apertures.

Plot 65 illustrates the ion flux density 1 meter away from a projection head when the iris plate aperture is $\frac{1}{4}$ inch in diameter. As can be seen from plot 65, the maximum output occurs at 90°, which is directly in front of the mouth of the ion cup projection head. The ion flux density on either side tapers off rather rapidly. Thus, a $\frac{1}{4}$ inch diameter aperture in the iris plate produces a very directional projection head as well as restricting the ion output.

By maintaining the ion cup dimensions constant and increasing the diameter of the aperture in the iris plate to $\frac{3}{8}$ inch, the plot 67 was obtained. Here again, the maximum output was at 90°, directly in front of the projection head. The output on either side decreased in the manner illustrated so that at an angle of about 20° from the projector head at a radial distance of 1 meter, the reading was approximately $1.5 \times 10^{-9}$ amperes per square centimeter. A reading of $6 \times 10^{-9}$ amperes per square centimeter was obtained directly in front of the projection head at a distance of 1 meter. As can be seen by comparing the plot with plot 65, by enlarging the aperture of the iris plate, the directionality of the ion flux decreases and the ion cloud density increases.

Plot 69 illustrates the test results of the projection head which was changed by enlarging its iris plate aperture to $\frac{1}{2}$ inch diameter. Plot 71 illustrates a projection head having a $\frac{5}{8}$ inch diameter aperture in its iris plate. Plot 73 illustrates the test results of a projection head having a $\frac{3}{4}$ inch diameter aperture in its iris plate. Plot 75 illustrates a $\frac{7}{8}$ inch diameter aperture in the iris plate. As can be seen from plot 69, and specifically, plots 71, 73, and 75, the larger apertures in the iris plates provide almost a constant ion flux density from 0° to 180° at a distance of 1 meter from the projection head. This shows that the projection head provides a fairly uniform distribution of ions from the projector head. The code chart 77, located on FIG. 4, identifies the individual plots 65, 67, 69, 71, 73, and 75 to the particular aperture sizes utilized in the iris plate of the projection head.

The spherical equal-energy plot of FIG. 5 illustrates the performance of the ion projection head built according to the present invention utilizing different size apertures in the iris plate. The radial distances 83 from the projection head 81 are shown as varying from 110 centimeters to 140 centimeters. It should be remembered that the open end of the projection head 81 is lying in a plane which is perpendicular to the plane of the paper of FIG. 5. The readings were taken from 0° to 180° in a plane defined by the paper of FIG. 5 at radial distances from the projection head identified by the circles 85 of the plot. This plot shows the radial distance from the projection head varying while the ion flux density was standardized at $1 \times 10^{-9}$ amperes per square centimeter. The code chart 95 of FIG. 5 identifies the various plots to the aperture size of the iris plate utilized. The dimensions of the ion cup were at all times maintained constant.

For a projection head utilizing a $\frac{1}{2}$ inch aperture in the iris plate, plot 87 was the result. As can be seen from plot 87, a $1 \times 10^{-9}$ amperes per square centimeter reading was present at over 130 centimeters from the projection head directly in front of it. The formation of the ion cloud, having a front of $1 \times 10^{-9}$ amperes per square centimeter, is as illustrated by plot 87.

Likewise, lot 89 illustrates the $1 \times 10^{-9}$ amperes per square centimeter ion cloud produced by a projection head utilizing a $\frac{5}{8}$ inch aperture in the iris plate. Plot 91 illustrates a projection head utilizing a $\frac{3}{4}$ inch aperture in the iris plate. Plot 93 illustrates a projection head utilizing a $\frac{7}{8}$ inch aperture in the iris plate.

As can be seen by comparing the plots of FIG. 5, the performance of the $\frac{5}{8}$ inch, $\frac{3}{4}$ inch, and $\frac{7}{8}$ inch diameter apertures in the iris plate are fairly similar in producing a uniform distribution.

What has been described is an ion projection head that provides a relatively extensive ion cloud for its dimensional size, is capable of controlling the ion propagation and projection and does so with relative safety. It should be understood, of course, the foregoing disclosure relates only to a preferred embodiment of the invention and that numerous modifications may be made therein without departing from the spirit and scope of the invention as set forth in the appended claims.

What is claimed is:

1. An ion cloud projection head for use with free-air ion-cloud generating apparatus utilizing a point electrode, the projector head comprising:

an ion cup, said cup containing said point electrode therein pointed towards the mouth of the cup; and an iris plate having an aperture therethrough overlaying the mouth of said ion cup; a cylinder with an aperture therethrough attached to the closed end of said cup; support means fastened externally to the closed end of said cup; and cylindrical stem means having an aperture therethrough sufficent to recieve said cylinder therein.

2. The ion cloud projection head of claim 1 wherein said ion cup has a spherical internal surface of curvature.

3. The ion cloud projection head of claim 1 wherein said point electrode is located in said cup so as to have its axis of symmetry perpendicular to said iris plate and intersecting the center of the aperture therein.

4. The ion cloud projection head of claim 1 wherein said iris plate is a circular wafer having an external diameter that is greater than the mouth of said ion cup.

5. The ion cloud projection head of claim 4 wherein the aperture of said iris plate is circular, having its center at the center of said circular wafer.

6. The ion cloud projection head of claim 5 wherein said ion cup has a spherical internal surface of curvature.

7. The ion cloud projection head of claim 6 wherein said point electrode lies with its axis of symmetry in the axis of symmetry of said iris plate.

8. The ion cloud projection head of claim 1 wherein said ion cup has a spherical internal surface of curvature, and said point electrode lies with its axis of symmetry on the major axis of revolution of said ion cup.

9. The ion cloud projection head of of claim 1 wherein said support means further includes a plurality of fins fastened externally to the closed end of said ion cup perpendicular to its surface along radial lines extending from said cylinder.

10. The ion cloud projection head of claim 1 further comprising:

a conductive wire connected to the point electrode located in said ion cup and passing through the small aperture of said ion cup, the aperture of said cylinder and the aperture of said cylindrical stem in turn; and a pluggable connector connected to said conductive wire and fastened to the aperture of said cylindrical stem.

11. The ion cloud projection head of claim 10 wherein said iris plate is circular, having an external diameter that is greater than the diameter of the mouth of said ion cup.

12. The ion cloud projection head of claim 11 wherein the aperture of said iris plate is circular, having its center coincident with the center of said iris plate.

13. The ion cloud projector head of claim 12 wherein said iris plate has a circular recess symmetrical about the circular aperture and slightly larger in diameter than the external diameter of the mouth of the iris cup.

14. The ion cloud projection head of claim 8 wherein said iris plate is circular, having an external diameter that is greater than the external diameter of the open end of said ion cup.

15. The ion cloud projection head of claim 14 wherein the aperture of said iris plate is circular with its center coincident with the center of said iris plate.

16. The ion cloud projection head of claim 15 wherein said iris plate has a circular recess symmetrical about the circular aperture and slightly larger in diameter than the external diameter of the open end of said iris cup.

17. The ion cloud projection head of claim 16 wherein the circular aperture of said iris plate has a diameter in the range from two-eights to $\frac{7}{8}$ of an inch.

18. The ion cloud projection head of claim 17 wherein the diameter of said iris plate is about $2\frac{1}{4}$ inches and the external diameter of the open end of said ion cup is about $1\frac{5}{8}$ inches.

* * * * *